US010415865B2

(12) United States Patent
Boarman et al.

(10) Patent No.: US 10,415,865 B2
(45) Date of Patent: Sep. 17, 2019

(54) REFRIGERATOR WITH WET ICE STORAGE

(71) Applicant: Whirlpool Corporation, Benton Harbor, MI (US)

(72) Inventors: Patrick J. Boarman, Evansville, IN (US); Brian K. Culley, Evansville, IN (US); Gregory Gene Hortin, Henderson, KY (US); Mark E. Thomas, Corydon, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1107 days.

(21) Appl. No.: 13/646,901

(22) Filed: Oct. 8, 2012

(65) Prior Publication Data

US 2014/0096544 A1 Apr. 10, 2014

(51) Int. Cl.

| | |
|---|---|
| ***F25C 1/18*** | (2006.01) |
| ***F25C 5/182*** | (2018.01) |
| ***F25D 23/12*** | (2006.01) |
| ***F25C 5/20*** | (2018.01) |

(52) U.S. Cl.

CPC ..... *F25C 1/18* (2013.01); *F25C 5/182* (2013.01); *F25C 5/22* (2018.01); *F25D 23/12* (2013.01)

(58) Field of Classification Search

CPC .. F25C 5/182; F25C 1/18; F25C 5/005; F25C 5/22; F25D 23/12

USPC ..... 62/312, 459, 462, 421, 422, 424, 441, 62/443, 446, 444

See application file for complete search history.

(56) References Cited

U.S. PATENT DOCUMENTS

| | | | | |
|---|---|---|---|---|
| 1,874,161 | A * | 8/1932 | Belshaw | 62/423 |
| 2,247,903 | A | 7/1941 | Brace | |
| 2,247,904 | A | 7/1941 | Brace | |
| 2,359,780 | A | 10/1944 | Muffly | |
| 2,429,851 | A | 10/1947 | Swann | |
| 2,524,815 | A | 10/1950 | Leeson | |
| 2,656,689 | A | 10/1953 | Muffly | |
| 2,672,017 | A * | 3/1954 | Muffly | F25C 1/06 62/132 |

(Continued)

FOREIGN PATENT DOCUMENTS

| | | | |
|---|---|---|---|
| WO | 20080130712 | A1 | 10/2008 |
| WO | 2009078562 | A1 | 6/2009 |
| WO | 2010099454 | A2 | 9/2010 |

OTHER PUBLICATIONS

European Patent Office, "European Search Report," issued in connection with European Patent Application No. 13173609.2, dated Aug. 29, 2016, 8 pages.

*Primary Examiner* — Emmanuel E Duke

(74) *Attorney, Agent, or Firm* — Nyemaster Goode, P.C.

(57) ABSTRACT

A refrigerator may include a refrigerator cabinet and at least one compartment disposed within the refrigerator cabinet, an ice maker for making wet ice disposed within the refrigerator cabinet, a bucket for storing the ice, the bucket positioned to receive the wet ice from the ice maker, and a drain in the bucket for draining water from the bucket. A method of making ice in a refrigerator includes making ice using an ice maker of the refrigerator, conveying the ice from the ice maker to a bucket having a drain, maintaining the ice in the bucket at a temperature above freezing to allow the ice to melt to water, and draining the water from the bucket.

20 Claims, 9 Drawing Sheets

(56) References Cited

U.S. PATENT DOCUMENTS 2,866,322 A * 12/1958 Muffly ..... F25C 1/12 137/262
2,982,113 A * 5/1961 Pichler ..... 62/302
3,146,601 A * 9/1964 Gould ..... 62/3.6
3,146,606 A 9/1964 Grimes
3,364,694 A * 1/1968 Cohen et al. ..... 62/265
3,537,273 A * 11/1970 Alvarez ..... F25C 1/24 222/233
3,667,249 A * 6/1972 Brown ..... F25C 5/185 62/312
3,921,414 A 11/1975 Bright
4,089,436 A * 5/1978 Marks ..... F25C 5/005 221/15
4,262,489 A * 4/1981 Sakamoto ..... C02F 1/22 62/124
4,412,429 A * 11/1983 Kohl ..... 62/347
4,785,641 A 11/1988 McDougal
4,848,102 A * 7/1989 Stanfill ..... F25C 1/12 62/348
5,014,523 A 5/1991 Kohl
5,077,985 A * 1/1992 Buchser ..... F25C 5/005 222/146.6
5,297,394 A * 3/1994 Frohbieter et al. ..... 62/135
5,425,243 A 6/1995 Sanuki
5,987,900 A * 11/1999 Love ..... B67D 1/0857 62/348
6,000,225 A 12/1999 Johnson
6,058,731 A 5/2000 Byczynski
6,148,621 A 11/2000 Byczynski
6,148,663 A 11/2000 Yamada
6,349,556 B1 2/2002 Barnett
6,425,258 B1 7/2002 Barnett
6,935,124 B2 8/2005 Takahashi
6,952,937 B2 * 10/2005 Choi ..... F25C 1/08 62/347
7,062,936 B2 6/2006 Rand
2005/0076654 A1 * 4/2005 Chung ..... F25D 11/02 62/66
2008/0034780 A1 2/2008 Lim
2008/0083235 A1 * 4/2008 Wang ..... F25C 1/04 62/135
2008/0264090 A1 * 10/2008 Sowa et al. ..... 62/344
2009/0165471 A1 * 7/2009 Rafalovich et al. ..... 62/66
2009/0211292 A1 * 8/2009 Smith et al. ..... 62/344
2010/0147008 A1 * 6/2010 Watson et al. ..... 62/340
2010/0218518 A1 * 9/2010 Ducharme et al. ..... 62/66
2010/0218540 A1 9/2010 McCollough
2010/0326112 A1 * 12/2010 Prabhakar et al. ..... 62/259.1
2011/0185760 A1 8/2011 Suh
2011/0209483 A1 9/2011 Hall
2012/0118001 A1 5/2012 Mitchell
2012/0324917 A1 * 12/2012 Bortoletto ..... F25C 1/12 62/71

* cited by examiner

REFRIGERATOR WITH WET ICE STORAGE

FIELD OF THE INVENTION

The present invention relates to refrigerators. More particular, the present invention relates to refrigerators with wet ice storage.

BACKGROUND OF THE INVENTION

Wet ice or clear ice is a desirable form of ice which is generally transparent and generally appears not to have air or other impurities associated with it. One of the problems with refrigerators which make such ice is how to store it in a manner which does not impact its quality. Therefore, what is needed is a refrigerator which provides for ice storage which permits wet ice to be stored.

SUMMARY OF THE INVENTION

Therefore it is a primary object, feature, or advantage of the present invention to improve over the state of the art.

It is a further object, feature, or advantage of the present invention to provide for wet ice storage.

A still further object, feature, or advantage of the present invention is to remove melt water from the wet ice storage.

Another object, feature, or advantage of the present invention is to provide for removing melt water from the refrigerator, recycling the melt water, or evaporating the melt water.

One or more of these and/or other objects, features, and advantages of the present invention will become apparent from the specification and claims that follow. No single embodiment need exhibit each and every object, feature, and advantage as different embodiments may have different objects, features, or advantages. The present invention is not to be limited by or to these objects, features, and advantages.

According to one aspect, a refrigerator is provided. The refrigerator may include a refrigerator cabinet and at least one compartment disposed within the refrigerator cabinet. The refrigerator may further include an ice maker for making ice disposed within the refrigerator cabinet, a bucket for storing the ice, the bucket positioned to receive the ice from the ice maker, and a drain in the bucket for draining water from the bucket.

According to another aspect, a method of making ice in a refrigerator is provided. The method includes making ice using an ice maker of the refrigerator, conveying the ice from the ice maker to a bucket having a drain. The method further includes maintaining the ice in the bucket at a temperature above freezing to allow the ice to melt to water, and draining the water from the bucket.

According to another aspect, a refrigerator includes a refrigerator cabinet, an ice maker for making ice disposed within the refrigerator cabinet, and a bucket for storing the ice within the refrigerator cabinet. The refrigerator is configured to maintain the ice in the bucket at a temperature above freezing to allow the ice to melt to water and the bucket is configured to remove the water from the bucket.

According to another aspect, a refrigerator includes a refrigerator cabinet, an ice maker for making ice disposed within the refrigerator cabinet, and a bucket for storing the ice within the refrigerator cabinet, the ice bucket having insulated upper walls and a funnel at a bottom end of the bucket for funneling ice from the bucket, a drip edge and a water trap to convey water towards a drain.

DETAILED DESCRIPTION

Figure 1:
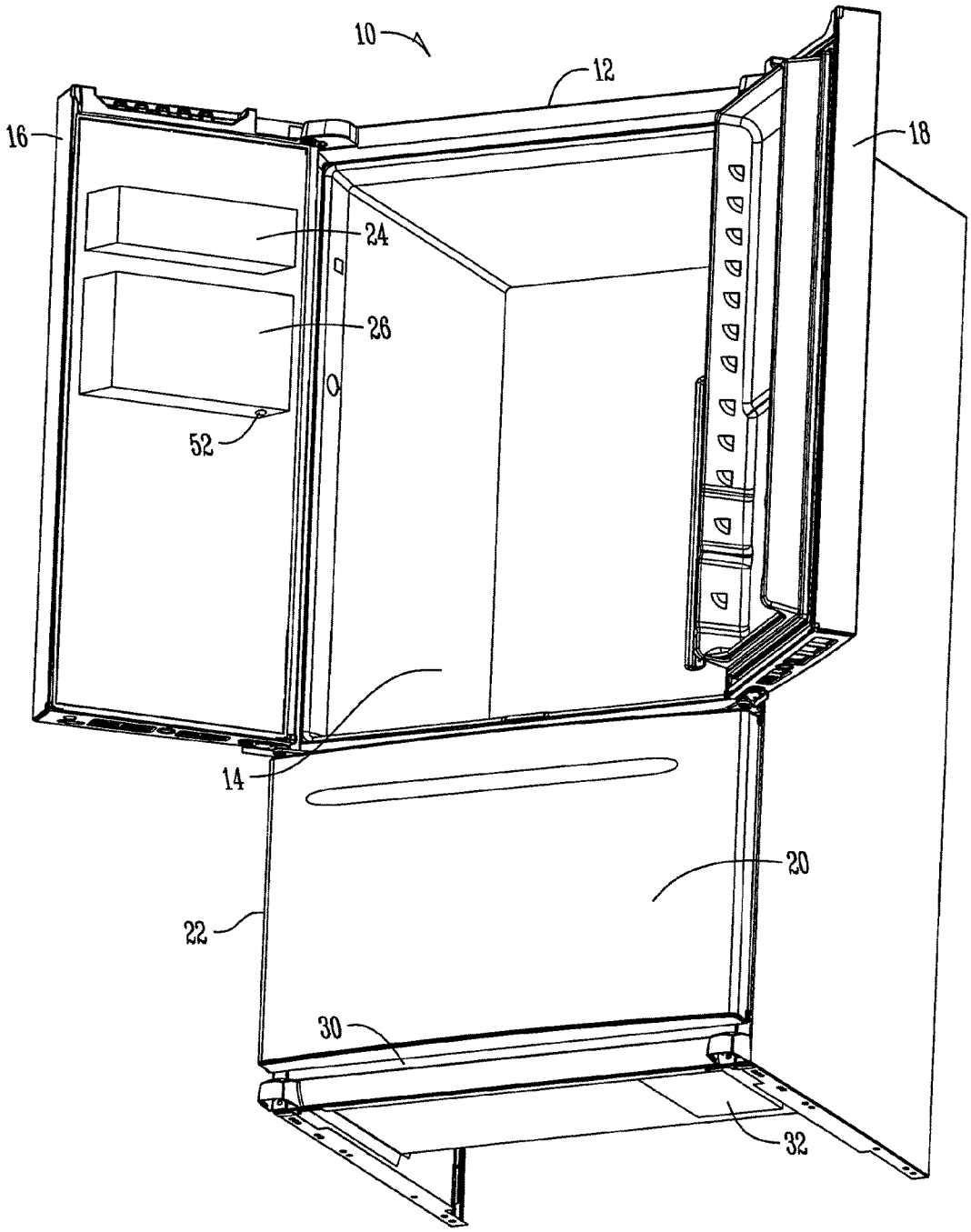
FIG. 1 illustrates one embodiment of a refrigerator.

FIG. 1 illustrates one embodiment of a refrigerator of the present invention. In FIG. 1 a refrigerator 10 has a bottom mount freezer with French doors. It is should be understood that the present invention may be used in other configurations including side-by-side refrigerator configurations and other types of configurations. The refrigerator 10 has a refrigerator cabinet 12. One or more compartments are disposed within the refrigerator cabinet 12. As shown in FIG. 1, a fresh food compartment 14 is shown with French doors 16, 18 providing access to the fresh food compartment 14. Below the fresh food compartment 14 is a freezer compartment 20 which may be accessed by pulling drawer 22 outwardly.

Mounted on the door 16 is an ice maker 24. An ice bucket 26 such as a container to hold or store ice is also mounted on the door 16. As shown in FIG. 1, the ice bucket 26 is positioned below the ice maker 24. Preferably, the ice maker 24 is configured to make clear ice or wet ice which is ice which is generally transparent and generally appears not to have air or other impurities. Such ice is generally made at a temperature near freezing.

There is a drain 52 in the ice bucket 26. To maintain the ice as clear ice, or wet ice, ice is stored in the ice bucket 26 temporarily and allowed to melt thereby resulting in melt water. The melt water may be separated from the ice stored in the ice bucket 26 and released. The melt water may then be conveyed from the ice bucket 26 through the drain 52 to another location. Alternatively, the melt water may be collected in the ice bucket 26. Although various locations are contemplated to drain the melt water, as will be discussed with respect to various embodiments, one such location is an evaporator 32 in the machine compartment 30 of the refrigerator 10. Alternatively, the melt water may be drained to evaporator trays elsewhere in the refrigerator such as in the fresh food or refrigeration compartment or the melt water may be drained to a reservoir that a user empties, or the melt water may be recycled such as to be re-frozen into cubes, dispensed as drink water, misted, or drained from the refrigerator.

Figure 2:
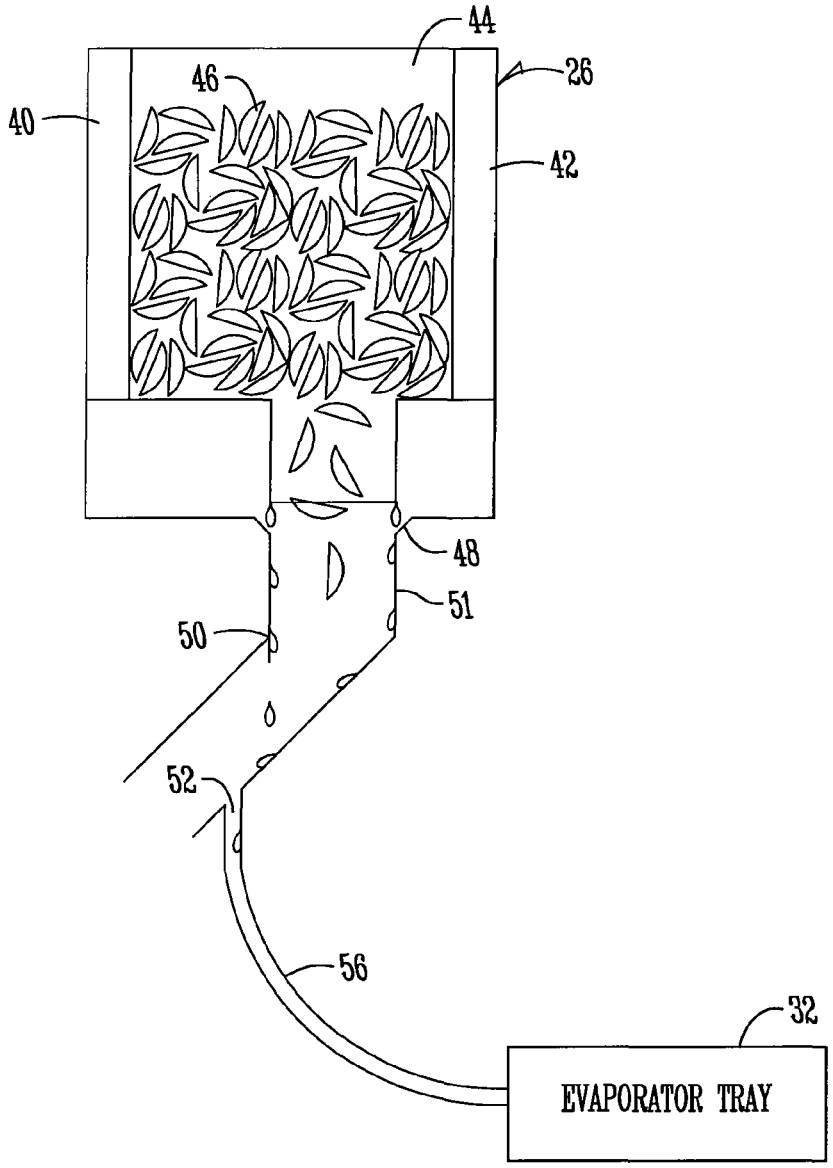
FIG. 2 illustrates one embodiment of an ice storage bucket where melt water from the ice storage bucket is conveyed to an evaporator.

FIG. 2 illustrates one example of an ice bucket 26 with ice cubes 46 stored therein. The ice bucket 26 may have insulated walls such as insulated upper walls 40, 42 forming an integral one piece chamber 44. A funnel 48 may be used to funnel ice 46 away from the ice bucket to another location such as to a dispenser. A drip edge 50 may be provided. As ice melts in the ice bucket 26 the melt water may be conveyed down edges of a chute 51 and may then be captured in a water trap 52. The melt water may then be conveyed through a gutter or tube 56 to an evaporator tray 32. The melt water may then be evaporated at the evaporator tray 32. The drip edge 50 may be generally above the water trap 52 so that droplets of melt water fall into or above the water trap 52.

Figure 3:
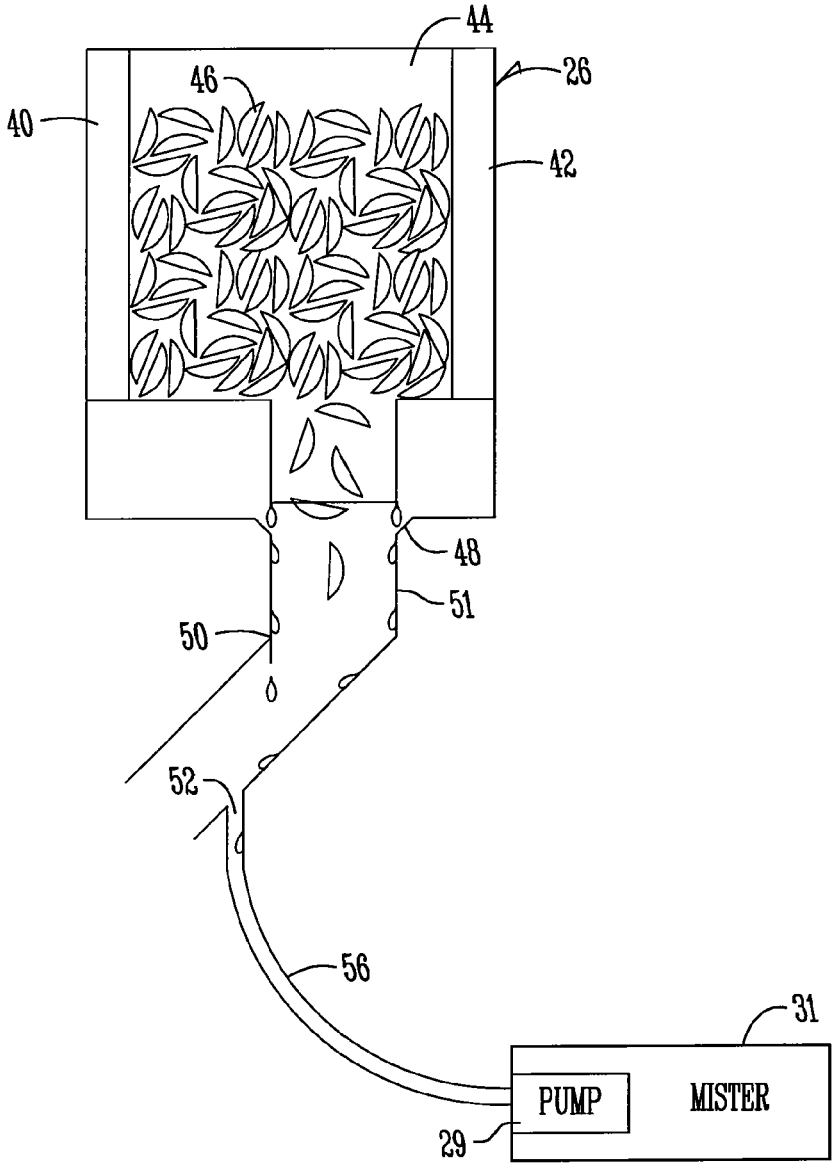
FIG. 3 illustrates another embodiment of an ice storage bucket where melt water from the ice storage bucket is conveyed to a mister.

FIG. 3 illustrates another embodiment. In FIG. 3, instead of routing melt water from the ice bucket 26 to an evaporator, melt water is routed to be used for an alternative purpose. For example, the melt water may be routed to a pump 29. As shown in FIG. 3, the melt water may be routed to a mister 31 having a pump 29. The mister 31 may be positioned within a refrigeration compartment to mist contents within the fresh food or refrigeration compartment. For example, the mister 31 may be used to mist fruits or vegetables. Alternatively, the mister may be used to mist the melt water outside of the refrigerator so as to function as a humidifier. In addition, the pump 29 may be used in alternative configurations where a mister is not used.

Figure 4:
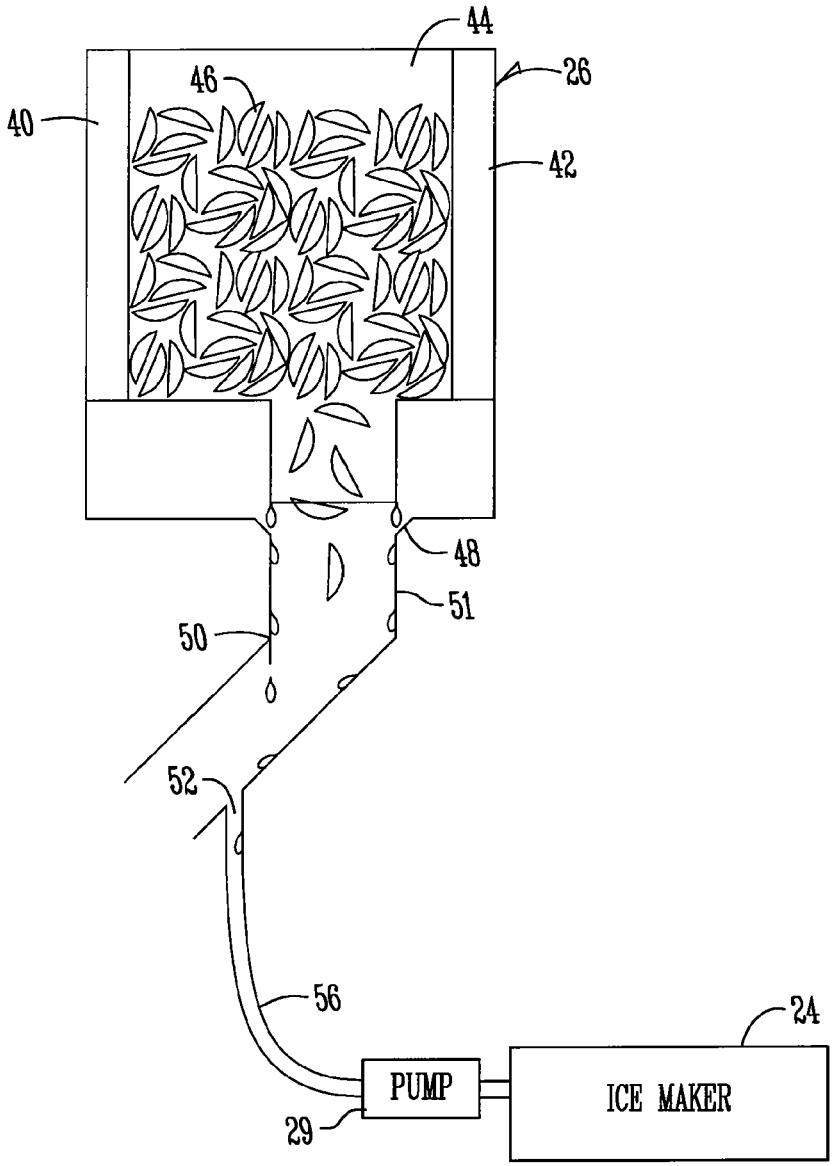
FIG. 4 illustrates another embodiment of an ice storage bucket where melt water from the ice storage bucket is conveyed to an ice maker.

FIG. 4 illustrates another embodiment. In FIG. 4, instead of routing melt water from the ice bucket to an evaporator, melt water is routed to the ice maker 24 using a pump 29. Thus, melt water can be recycled and used to produce additional ice. Where melt water is used in this way, it is noted that the melt water is already at a temperature just above freezing which minimizes the amount of energy needed to cool water in comparison to using water which is at a warmer temperature.

Figure 5:
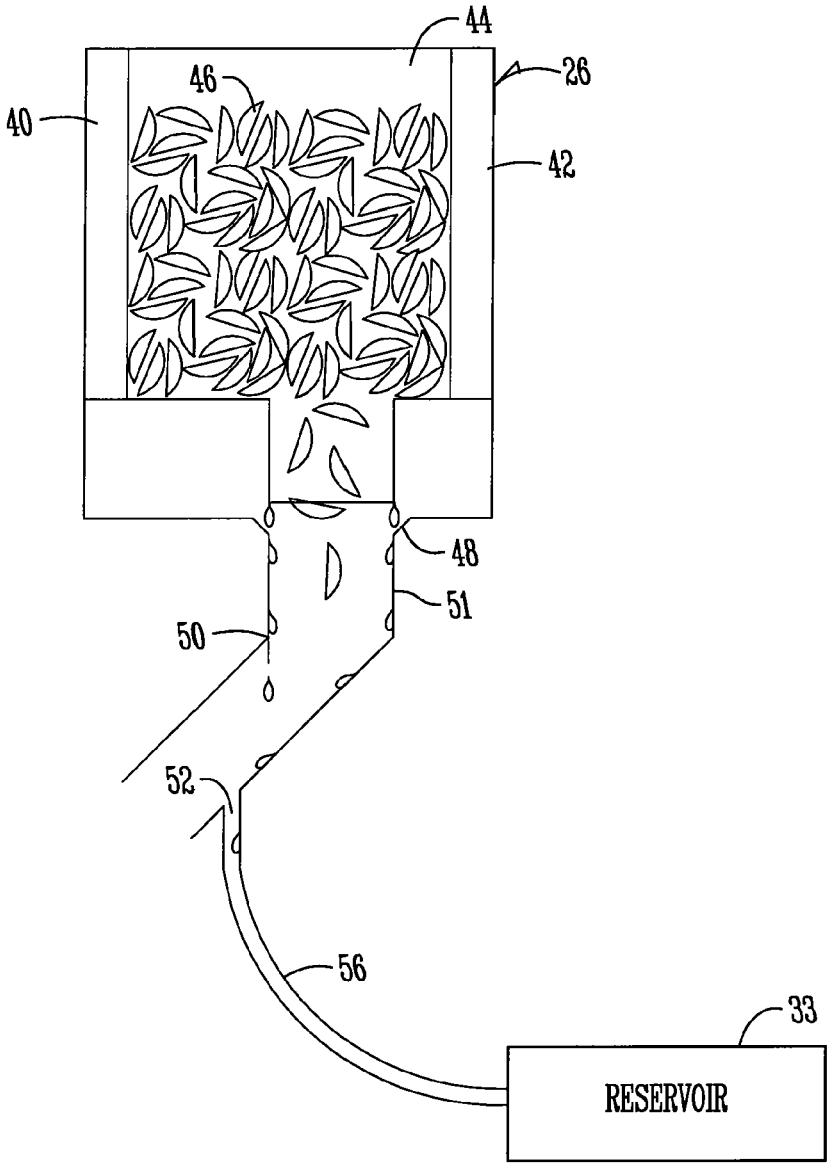
FIG. 5 illustrates another embodiment of an ice storage bucket where melt water from the ice storage bucket is conveyed to a reservoir.

FIG. 5 illustrates another embodiment. In FIG. 5, melt water from the ice bucket 26 is routed to a reservoir 33. The reservoir may be a user removable reservoir which can be periodically emptied by a user of the refrigerator to remove the collected melt water from the refrigerator. Alternatively, the reservoir may collect water to be used as consumable drink water.

Figure 6:
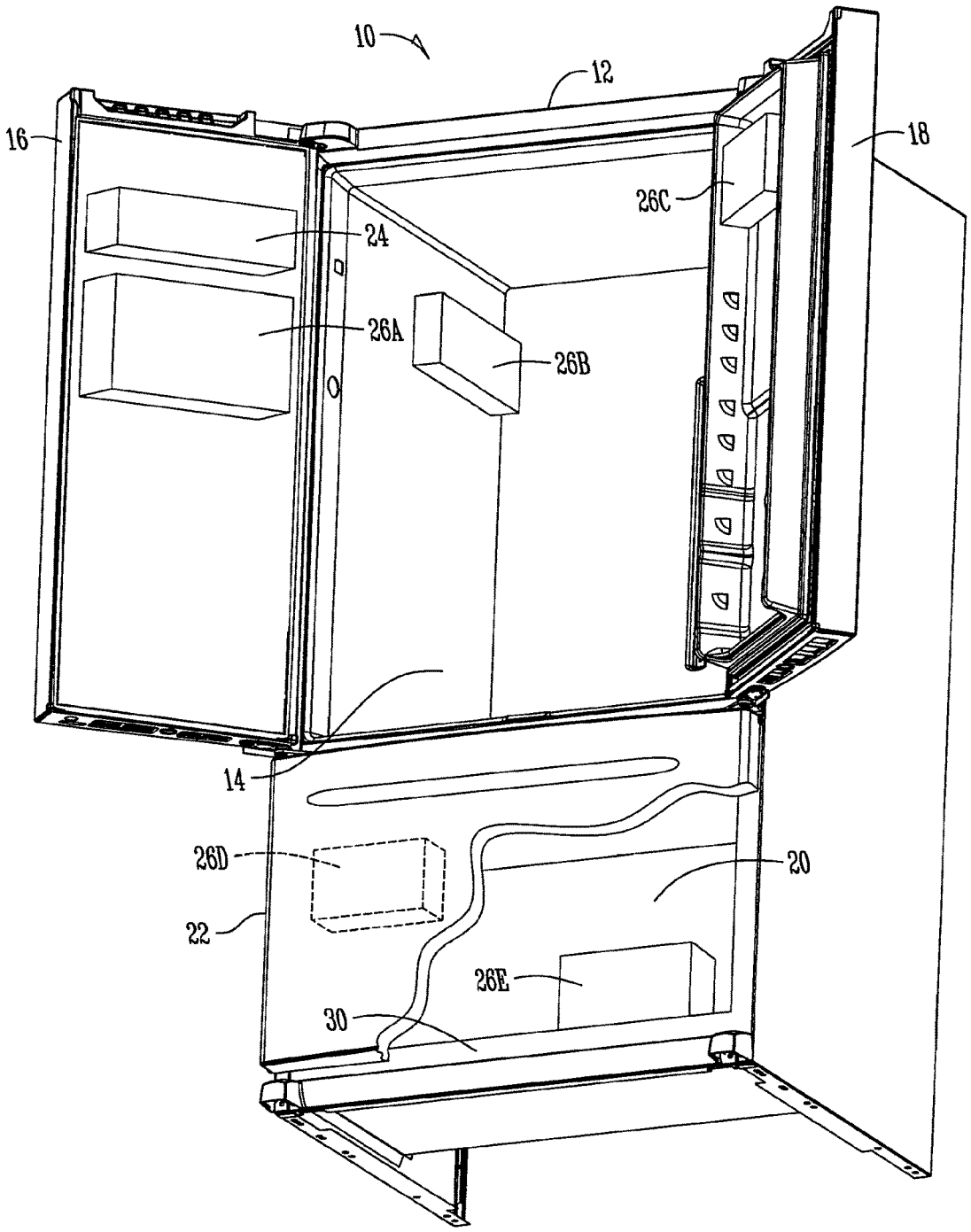
FIG. 6 illustrates alternative placements of the ice storage bucket which may be used in alternative embodiments.

FIG. 6 illustrates alternative placements of the ice storage bucket which may be used in alternative embodiments. Note that the ice storage bucket may be placed in any number of different locations associated with the refrigerator 10. This may include placing the ice storage bucket 26A on a first French door 16 to the refrigeration compartment 14. Alternatively ice storage bucket 26B may be placed within the refrigeration or fresh food compartment 14. Ice storage bucket 26C is shown on a second French door 18. Alternatively, the ice storage bucket 26D may be placed on a drawer 22 of the freezer compartment 20. In another embodiment, the ice storage bucket 26E may be placed within the freezer compartment 20. Thus, it is to be understood that the present invention contemplates that an ice storage bucket may be placed in any number of locations. The particular location of the ice storage bucket may be determined based on the location of the ice maker, the manner in which ice is conveyed from the ice maker to the ice bucket, the location of an ice dispenser, the manner in which ice is conveyed from the ice storage bucket to the ice dispenser if present, the manner in which the ice storage bucket is cooled, and other considerations. Although a French door refrigerator with a bottom mount freezer is shown, it is to be understood that the present invention contemplates that other configurations of refrigerators may be used include side-by-side refrigerators, other configurations with bottom mount freezers, and other configurations with top mount freezers.

Figure 7:
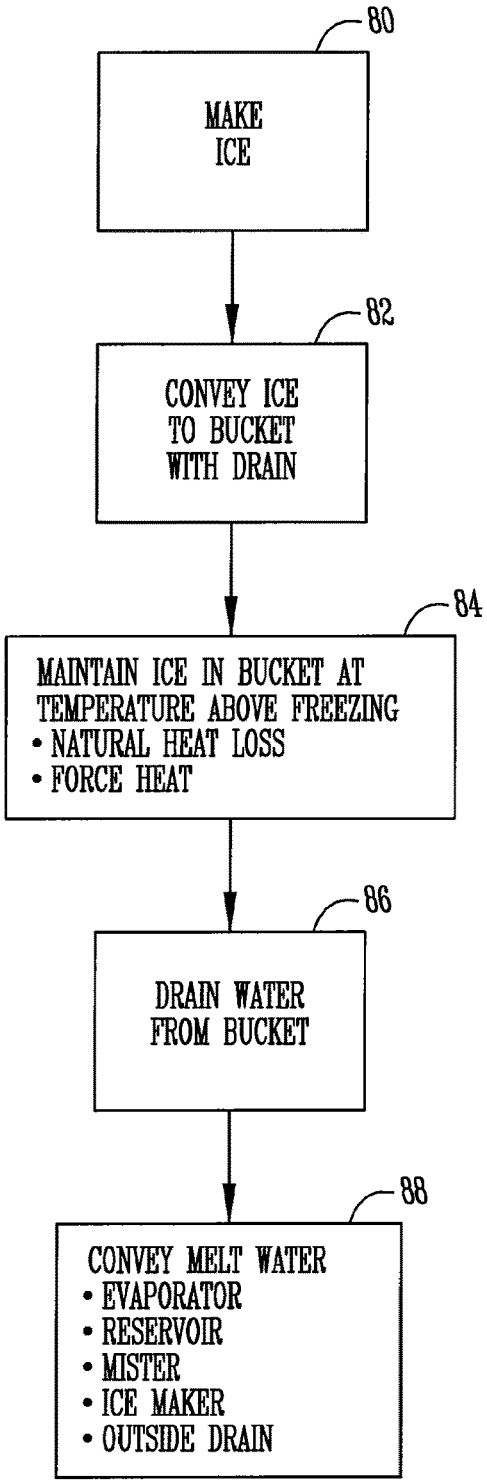
FIG. 7 is a flow chart illustrating one embodiment of a method of the present invention.

FIG. 7 is a flow chart illustrating one embodiment of a method of the present invention. In step 80 ice is made. Preferably, the ice is made in a process which allows for clear ice or wet ice to be made. In step 82, the ice is conveyed to the bucket with a drain. In step 84, the ice is maintained within the bucket at a temperature above freezing. This may be accomplished through natural heat loss or by forcing heat. Examples of force heat methods may include warm air ducted into the above zero temperature compartment, a heater, conduction of heat, a heat pipe and heat loops, a thermoelectric, and a fluid and heat exchanger. The manner in which the ice is maintained within the bucket at a temperature above freezing may depend upon the location of the bucket. For example, if the ice storage bucket is positioned within a refrigeration compartment then natural heat loss may be relied upon. Alternatively, if the ice storage bucket is positioned within a freezer compartment than force heat methods may be used to maintain the ice in the bucket at temperature above freezing. It is further contemplated that natural heat loss may provide for improved energy efficiency. Next, in step 86, water is drained in the bucket. In step 88, melt water drained from the bucket may be conveyed to another location which may be remote from the ice bucket. The melt water may be conveyed to an evaporator, a reservoir, a mister, an ice maker, or other location. The melt water may be recycled or repurposed within the refrigerator. Alternatively, the melt water may be removed from the refrigerator such as by conveying the melt water to an outside drain or misting the water outside of the refrigerator into its environment to function as a humidifier, or to water plants/sprouts, or for other purposes.

Figure 8:
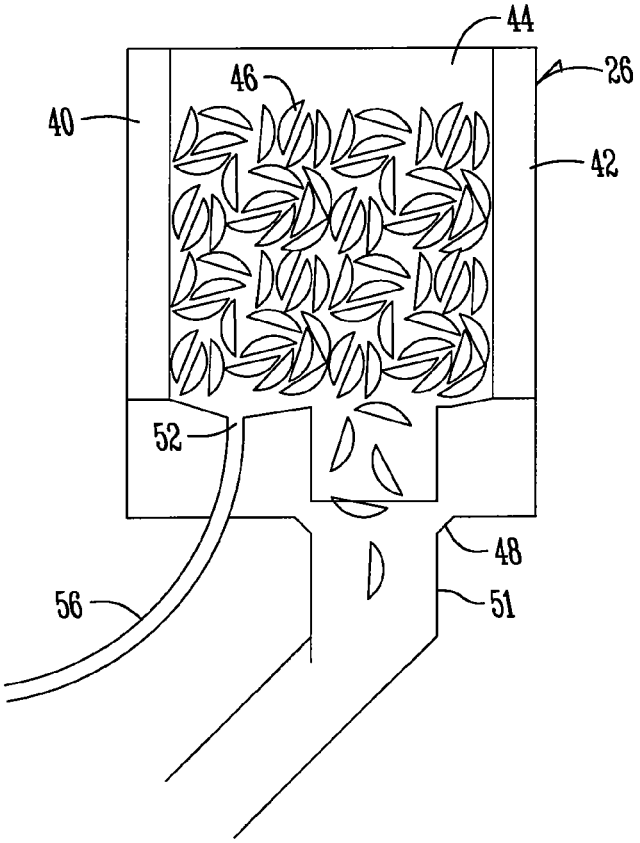
FIG. 8 illustrates another embodiment of an ice storage bucket where melt water is conveyed to a remote location.

FIG. 8 illustrates another embodiment of the ice bucket 26 of the refrigerator. In FIG. 8, the drain 52 is within the ice bucket 26. A gutter or tube 56 may be used to remove melt water and convey the melt water to another location, such as a pump, a reservoir, an evaporator or elsewhere.

Figure 9:
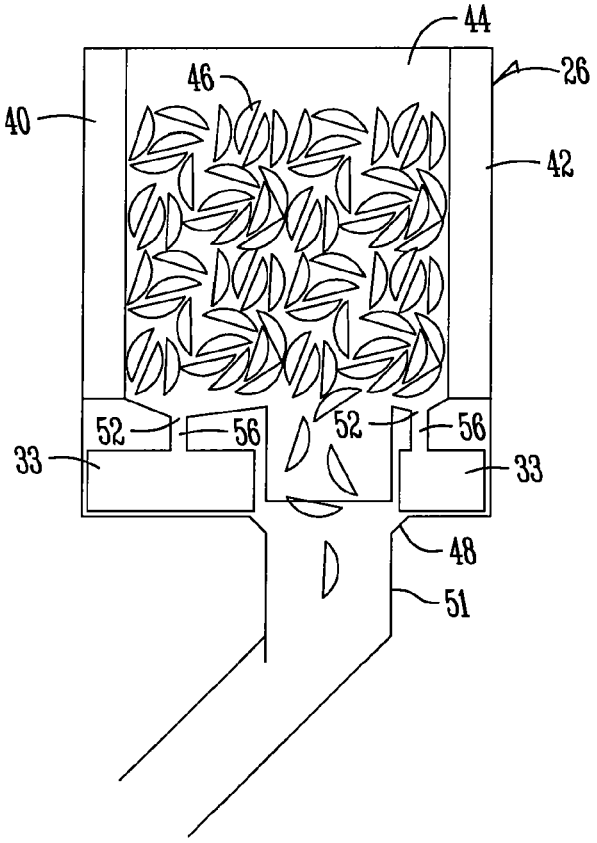
FIG. 9 illustrates another embodiment of an ice storage bucket where melt water is stored in a reservoir.

FIG. 9 illustrates another embodiment of the ice bucket 26 of the refrigerator. In FIG. 9, one or more drains 52 may be positioned within the ice bucket 26 and corresponding gutters or tubes 56 may be used to convey melt water to reservoirs 33 within the ice bucket. The present invention contemplates that melt water in the reservoir(s) 33 may be temporarily stored and/or may be recycled.

The invention has been shown and described above, and it is understood that many alternatives modifications, substitutions, and additions may be made which are within the intended spirit and scope of the invention. For example, the present invention may be used in various different types of refrigerator configurations, the ice storage bucket may be placed in various locations throughout the refrigerator, the ice bucket and drain may have variations in structure, once drained melt water may be recycled, repurposed, or removed from the refrigerator. These and other variations, options, and alternatives may be used with the present invention.

What is claimed is:

1. A refrigerator comprising:

a refrigerator cabinet;

at least one compartment disposed within the refrigerator cabinet;

a door for providing access to the cabinet disposed on the cabinet and having an ice dispenser operable with the door in a closed position;

an ice maker for making ice disposed within the refrigerator cabinet;

a bucket for storing the ice, the bucket positioned to receive the ice from the ice maker;

an opening at the bottom of the bucket;

a chute disposed below the opening with a first end disposed at the opening and a second end disposed at the ice dispenser; and a drain connected to the chute and extending downwardly from the opening for draining water from the bucket.

2. The refrigerator of claim 1 wherein the bucket is positioned below the ice maker.

3. The refrigerator of claim 1 wherein the bucket is stored on a door of the refrigerator cabinet.

4. The refrigerator of claim 1 wherein the bucket is positioned at a location in the refrigerator cabinet having a temperature above a freezing point of water.

5. The refrigerator of claim 1 wherein the at least one compartment comprises a fresh food compartment and the bucket is positioned within the fresh food compartment for storing wet ice at a temperature above a freezing point of water.

6. The refrigerator of claim 1 wherein the ice maker is positioned within a door of the at least one compartment.

7. The refrigerator of claim 1 wherein the ice maker is positioned within a fresh food compartment.

8. The refrigerator of claim 1 wherein the at least one compartment comprises a freezer compartment and wherein the bucket is positioned within a compartment held above a freezing point of water disposed within the freezer compartment.

9. The refrigerator of claim 8 wherein the above zero temperature compartment is maintained at a temperature above zero using at least one of warm air ducted into the compartment held above a freezing point of water, a heater, conduction of heat, a heat pipe and heat loops, and a fluid heat exchanger.

10. The refrigerator of claim 1 wherein the bucket is maintained at a temperature above a freezing point of water using heat loss occurring without a heater.

11. The refrigerator of claim 1 further comprising an evaporator, the drain fluidly connected to the evaporator.

12. The refrigerator of claim 11 wherein the evaporator is in a machine compartment of the refrigerator.

13. A method of making wet ice in a refrigerator, the method comprising:

making ice using an ice maker of the refrigerator;

conveying the ice from the ice maker to a bucket having a drain;

maintaining the ice in the bucket at a temperature above a freezing point of water to allow the ice to melt to water;

passing the ice and the water through an opening at the bottom of the bucket into a chute extending from the bottom of the bucket;

guiding the ice down the chute and to a dispenser disposed on a door of the refrigerator; and draining the water from the chute through an opening within the chute and through a conduit extending from the opening within the chute.

14. The method of claim 13 wherein the water is drained from the chute and through the conduit to an evaporator of the refrigerator.

15. The method of claim 13 wherein the bucket is positioned within a fresh food compartment of the refrigerator for storing the wet ice at a temperature above freezing.

16. The method of claim 15 wherein the bucket is positioned at a door of the fresh food compartment.

17. The method of claim 13 wherein the bucket is positioned within an above zero temperature compartment disposed within a freezer compartment of the refrigerator.

18. A refrigerator comprising:

a refrigerator cabinet having a door with an ice dispenser;

an ice maker for making ice disposed within the refrigerator cabinet;

a bucket for storing the ice within the refrigerator cabinet;

an opening in the bucket for draining water and dispensing ice;

a chute connected to and extending downwardly from the bucket at an upper end and terminating at the dispenser at a lower end to dispense ice and remove the water through the opening of the bucket;

a drain located on the chute between the bucket and the dispenser and in fluid connection with the chute; and wherein the refrigerator is configured to maintain the ice in the bucket at a temperature above freezing to allow the ice to melt to water.

19. The refrigerator of claim 18 further comprising a fresh food compartment disposed within the refrigerator cabinet and wherein the ice maker and the bucket are disposed within the fresh food compartment.

20. The refrigerator of claim 19 further comprising a freezer compartment disposed within the refrigerator cabinet and a compartment held above a freezing point of water disposed within the freezer compartment and wherein the bucket is disposed within the above zero temperature compartment disposed within the freezer compartment.

* * * * *